US006007955A

United States Patent [19]

Verhecken et al.

[11] Patent Number: 6,007,955

[45] Date of Patent: Dec. 28, 1999

[54] TONER COMPOSITION FOR USE IN TEXTILE PRINTING

[75] Inventors: André Verhecken, Mortsel; Paul Sterckx, Begijnendijk, both of Belgium

[73] Assignee: Agfa-Gevaert, N.V., Mortsel, Belgium

[21] Appl. No.: 09/301,331

[22] Filed: Apr. 29, 1999

Related U.S. Application Data

[60] Provisional application No. 60/095,476, Aug. 5, 1998.

[30] Foreign Application Priority Data

Jun. 4, 1998 [EP] European Pat. Off. ..... 98201846

[51] Int. Cl.[6] ..... G03G 9/09; G03G 9/087; G03G 13/16; D06P 5/20

[52] U.S. Cl. ..... 430/106; 430/110; 430/111; 430/126; 8/471

[58] Field of Search ..... 430/106, 110, 430/111, 126; 8/471

[56] References Cited

U.S. PATENT DOCUMENTS

| | | | |
|---|---|---|---|
| 4,420,307 | 12/1983 | Gorondy | 8/471 |
| 4,536,462 | 8/1985 | Mehl | 430/111 |
| 4,767,420 | 8/1988 | Mehl et al. | 8/470 |
| 5,236,799 | 8/1993 | Chen et al. | 430/109 |
| 5,366,836 | 11/1994 | Snelling | 430/106 |

FOREIGN PATENT DOCUMENTS 0 561 313 A1 9/1993 European Pat. Off. .

*Primary Examiner*—Roland Martin
*Attorney, Agent, or Firm*—Breiner & Breiner

[57] ABSTRACT

Toner particles comprising a toner resin and a thermosublimable dye wherein the resin has measured at 190° C. a viscosity, $\eta$, between 30 and 100 mPa.s and a tg$\delta$ such that $0.015 \leqq tg\delta/\eta \leqq 0.20$. Preferably tg$\delta$ such that $0.02 \leqq tg\delta/\eta 0.05$.

10 Claims, No Drawings

TONER COMPOSITION FOR USE IN TEXTILE PRINTING

This application claims benefit of provisional application 60,095,476 filed Aug. 5, 1998 pending.

FIELD OF THE INVENTION

This invention relates to toner particles comprising a toner resin and a thermosublimable dye or pigment for use in textile printing.

BACKGROUND OF THE INVENTION

Toner particles comprising a thermosublimable dye or pigment for use in sublimation transfer textile printing are quite well known in the art. When using said toners, the process for textile printing proceeds as follows. A toner image is formed on an intermediate substrate (e.g. paper, plastic sheet, etc.), the intermediate substrate carrying the toner image is contacted with textile and is heated for a (short) period of time. During this step the sublimable dye or pigment evaporates and enters the textile to be printed where the dye or pigment molecules diffuse into the fibre. After having the dye sublimated from the toner image to the fibres, the intermediate substrate carrying the toner image is removed. This system is especially well suited for printing on synthetic fibres, e.g. polyester.

In such a process it is important that a high amount of dye can be sublimated in a short period of time and that, during the contacting the toner image with the textile and heating it, a very low amount of toner resin is transferred to the textile. When a large amount of toner resin is transferred, the textile becomes stiff and the feel of the textile is changed at the place where the image is printed. This is quite undesirable since, especially when high-quality textiles are printed, the presence of toner resin can adversely affect the pleasure of wearing the printed textile or its draping properties.

Several propositions for toner particles comprising sublimable dye have been made for improving toner particles for use in textile printing, with toner particles containing sublimable dyes.

E.g. in U.S. Pat. No. 4,251,611 a method is described for producing single or multi-colour permanent copies by development of a latent electrostatic image, with a magnetic brush, using a toner consisting of polymer particles containing dye(s), which sublime or vaporise between 100 and 250 degrees C., and also a ferromagnetic substance. It is said that only pure dye is transferred, whilst the other components of the toner remain on the latent image and do not cause opacity or discoloration In U.S. Pat. No. 4,391,893 spherical magnetic toner particles are prepared from a magnetic product, a polymer, and a wax. The dye used sublimates at 100–200° C. and the wax is preferably a montana wax.

In U.S. Pat. No. 4,251,616, a dry electrophotographic developer consisting of a single type of particles containing an electrically conductive substance, a magnetic substance and a binder is disclosed. Typically the developer contains Carbon black (2–20%), dye(s) subliming or vaporising at 130–240 degrees C. a wax and a plasticiser. The binder is a polymer especially PVC, polystyrene or a copolymer of styrene with butadiene and an acrylic resin.

In GB-A 2,095,855 a two-component toner composition for developing latent electrostatic images is disclosed, comprising finely divided toner particles comprising a solid polymeric thermoplastic material, with a softening point (ball-ring) between 60 and 140° C.; and a heat-sublimable dyestuff which sublimes at 100–220° C. at atmospheric pressure and carrier particles.

In EP-A-082 163, an electrostatic single component developer is disclosed in the form of a dry fluid powder comprising spherical particles fixable by heat or pressure, comprising a binder which can be heated at 230° C. without appreciable decomposition, optionally electrically conductive or very fine magnetic particles, and at least 5% of at least one sublimable or vaporisable dye which in 30 seconds at 210° C. passes into the vapour state in an amt. of at least 60% at 100 hPa, whilst at atmospheric pressure under the same temperature, less than 50% passes into the vapour state in 30 seconds. The binder, having a softening point between 100 and 160° C. is especially cellulose esters, vinyl resins, vinyl copolymers, polyamides or polystyrene, and containing a wax chosen from polyethylene wax, aliphatic waxes or hydroxylated fatty acids.

In EP-A-561 313 a method for textile printing is described wherein a printed pattern on transfer material is formed using pigmented powder. The transfer printing, on synthetic fabrics or similar material, proceeds by sublimation of the pigment which is a finely ground powder contained in a pulverised heat sensitive synthetic resin. The resin has a melting point around 120° C.

The toner particles according to the references cited can be used for indirect textile printing, but there is still room for improvement.

OBJECTS AND SUMMARY OF THE INVENTION

It is an object of the invention to provide dry toner particles comprising a toner resin and a sublimable dye for textile printing, wherein upon contacting a toner image made with the fused toner particles with the textile and heating it, a large amount of dye is transferred to the textile and only a very low amount of toner resin is transferred together with the dye.

It is a further object of the invention to provide dry non-magnetic toner particles for textile printing, wherein upon contacting a toner image made with the toner particles with the textile and heating it, a large amount of dye is transferred to the textile and only a very low amount of toner resin is transferred together with the dye and that can he used as non-magnetic mono-component developer or in a multi-component developer together with magnetic carrier particles.

Further objects and advantages of the invention will become clear from the detailed description hereinafter.

The object of the present invention is realised by providing toner particles comprising a toner resin and a thermosublimable dye characterised in that said resin has 190° C. a viscosity, $\eta$, between 30 and 100 mPa.s and a tg$\delta$ such that $0.015 \leqq tg\delta/\eta \leqq 0.20$.

Preferably said toner resin has a tg$\delta$ such that $0.002 \leqq tg\delta/\eta \leqq 0.06$.

DETAILED DESCRIPTION OF THE INVENTION

Indirect textile printing with toner particles comprising sublimable dyes proceeds basically by printing a pattern on a transfer material by image-wise applying toner particles containing sublimable dyes (full colour images can be used) to said transfer material then, after fusing, the transfer paper is laid with the colour against the fabric to be printed, which is woven, non-woven or knitted polyester or similar synthetics, or mixtures of such synthetic fibres with up to 33% of natural or regenerated fibres. The fabric and transfer are passed over a heated calender at 180 to 260° C. with low pressure, and for a period of half to one minute. A toner image comprising toner particles according to this invention can not only beneficially be used for decorating textile materials, but also for decorating polymeric sheet or web material (e.g. polyvinylchloride sheets or webs, polyester sheets or webs, etc.). Also objects coated with a polymeric layer can be decorated using an indirect printing method with toner particles according to this invention.

It was known from the prior art that, in toner particles useful for textile printing and containing a sublimable dye the toner resin had to have a softening point lower than the sublimation temperature of the dye. Mostly it was said that polymers should have a softening point between 60 and 160° C. From the prior art, it seemed that once this condition was fulfilled, almost any well known resin was useful.

It was now found that fulfilling this condition alone was not sufficient for a toner resin to be useful in textile printing with sublimable dyes. E.g. toner particles comprising well known toner resins, as. ATLAC T500, registered trade name of Atlas Chemical Industries Inc. Wilmington, Del. U.S.A. for a linear polyester of fumaric acid and propoxylated bisphenol A with softening point around 100° C. and a sublimable dye, were indeed found not to be useful in indirect textile printing. Although good intermediate toner images on a transfer foil could be made, it showed that during the transfer from the intermediate image to the textile, not much of the dye sublimed and much of the resin was transferred, although the properties of the resin were within the scope of the prior art.

It was found that only toner resins having, at 190° C., a specific viscosity, $\eta$, and a specific ratio between TG$\delta$ and $\eta$ could beneficially be used. The viscosity $\eta$ at 190° C. had to be between 30 and 100 mPa.s and the tg$\delta/\eta$ at 190° C. between 0.010 and 0.20, preferably $0.010 \leqq tg\delta/\eta \leqq 0.06$. and most preferably the resin used in toner particles according to this invention has viscosity $\eta$ at 190° C. had to be between 30 and 100 mPa.s and a TG$\delta$ so that, at 190° C., $0.010 \leqq tg\delta/\eta \leqq 0.03$.

The rheological parameters of the toner resin are measured in a CLS$^2$ 500 RHEOMETER, trade name of TA Instruments, Newcastle, U.S.A.

It was found that various toner resins known in the art could be used for manufacturing toners useful in this invention, as long as it fulfilled the condition set out immediately above. The toner resin used can be a polycondensation polymer or a mixture of different polycondensation polymers as well as an addition polymer or a mixture of addition polymers. Also mixtures of polycondensation polymers and addition polymers and their hybrids are suitable as toner resin for toner particles useful in the present invention.

The sublimable dyes for incorporation in the toner particles can be any dye known in the art, having a sublimation temperature between 100–220° C. at atmospheric pressure.

The sublimable colorant can be e.g. (a) diarylamino anthraquinones; (b) monoacylamino-arylamino anthraquinones; (c) phenylamides of 1-phenylazo-2-hydroxy naphthalene-3-carboxylic acids (esp. in which the phenyl groups are free from N-containing substituents.); (d) phenyl- or naphthylamides of acetyl or benzoylacetic acids (esp. in which the phenyl groups are free from N-containing substituents.); or (e) alkylimides of 1,4-diaminoanthraquinone-2,3-dicarboxylic acid in which the aliphatic chain carries one or more phenoxy groups or phenylamino groups as disclosed in WO-A-83/00235. Also dye as disclosed in EP-A-773976 and EP-A-791 034 can beneficially be used.

Further interesting dyes for use in toner particles according to this invention are dyes as have been disclosed in GB-A-2,312,430, GB-A-2,312,431, GB-A-2,312,432, GB-A-2,312,433, GB-A-2,312,434, GB-A-2,312,435, GB-A-2,312,436 and GB-A-2,312,437.

Toner particles according to the present invention may also comprise a optical brightener.

The toner particles according to the present invention can be prepared by any of the toner preparing means known in the art.

Toner particles, according to the present invention are preferably prepared by extrusion or by melt-blending toner resin(s), toner ingredients as desired (e.g. pigment, dyes, charge controller, release agent, etc.) in a melt kneader for 30 minutes at an appropriate temperature, depending on the toner resin(s) and the sublimating dye(s) used. After cooling the solidified mass is pulverised and milled using an ALPINE Fliessbettgegenstrahlmühle type 100AFG (trade name) and further classified using an ALPINE multiplex zig-zag classifier type 100MZR (trade name). The pulverising and milling an classifying can also proceed by using other commercial apparatus. The classifying, e.g., can proceed by a classifier using the "Coanda"-effect as described in e.g. EP-A 608 902. The average particle size of the separated toner was measured by Coulter Counter model MULTISIZER (trade name).

Toner particles according to this invention can also be prepared by an "emulsion polymerisation" process. Such a process limited to the production of addition polymers, is described e.g. in U.S. Pat. No. 2,932,629, U.S. Pat. No. 4,148,741, U.S. Pat. No. 4,314,932 and EP-A 255 716. In this process a water-immiscible polymerizable liquid is sheared together with the toner ingredients (e.g. pigment, dyes, charge controller, release agent, etc.) to form small droplets emulsified in an aqueous solution, and the polymerisation of the monomer droplets takes place in the presence of an emulsifying agent. Initially the polymerizable monomers are in liquid form and only at the end of the polymerisation a suspension of solid polymer particles in the aqueous phase is obtained.

Toner particles according to this invention can also be prepared by a "polymer suspension" process. In such a process a pre-formed polymer is dissolved in an appropriate organic solvent, immiscible with water and with low boiling point, and the toner ingredients (e.g. pigment, dyes, charge controller, release agent, etc.) are dispersed in that solution. The resulting solution is dispersed in an aqueous medium that contains a stabiliser, the organic solvent is evaporated and the resulting particles are dried. The evaporation of the solvent can proceed by increasing temperature, by vacuum evaporation, by spray-drying as described in, e.g. U.S. Pat. No. 3,166,510, U.S. Pat. No. 3,338,991, electrostatic pulverising as described in, e.g. GB-A-2,121,203, etc.

Toner particles useful in this invention can have an average volume diameter ($d_{v50}$) between 3 and 20 $\mu$m, preferably between 5 and 15 $\mu$m and more preferably between 5 and 7 $\mu$m. The particle size distribution of said toner particles can be of any type. It is however preferred to have an essentially (some negative or positive skewness can be tolerated, although a positive skewness, giving less smaller particles than an unskewed distribution, is preferred) Gaussian or normal particle size distribution, either by number or volume, with a coefficient of variability (standard deviation divided by the average) (v) smaller than 0.5, more preferably of 0.3.

The toner particles of the present invention can comprise any further toner ingredient known in the art, e.g. charge control agents, fillers, release agent, etc. It can be magnetic or non-magnetic particles, the latter type being the preferred type. When the toner particles are non-magnetic they can be used as non-magnetic mono-component developer as well as in a multi-component developer in combination with magnetic carrier particles.

The toner particles can be used in any electrostatic printing apparatus, it can be used in electrophotographic apparatus wherein the toner particles are used for developing an electrostatic latent image as well as in printing apparatus of the Direct Electrostatic Printing type, wherein electrostatic printing is performed directly from a toner delivery means on a receiving substrate, the latter not bearing any image-wise latent electrostatic image, by means of an electronically addressable printhead structure. Devices for direct electrostatic printing are described in, e.g. EP-A-740 224, EP-A-780 740, EP-A-731,394, EP-A-812 696, etc. When the toner particles according to this invention are intended for use in Direct Electrostatic Printing (DEP) it is preferred to prepare the toner particles so that (i) said toner particles have as topological criterion that the ratio of the length of the long axis of the projected microscopic image of said particles to the length of the short axis, is between 1.00 and 1.40 and (ii) said toner particles after addition of 0.5% by weight of fumed hydrophobic silica having a specific surface area of 260 $m^2/g$ show a ratio of apparent density ($\rho_{app}$) over real density ($\rho_{real}$)

$$\frac{\rho_{app}}{\rho_{real}} \geq 0.52.$$

Such toner particles have been disclosed in EP-A-715 218.

The real density ($\rho_{real}$) of the toner particles was measured in accordance with conventional techniques in an apparatus such as the BECKMANN AIR COMPARIMETER (trade name), available from Beckmann Instruments, Chemin des Bourdon nr. 52-54, 93220 Gagny, France, wherein the volume of an accurately weighed quantity of toner particles is measured.

The apparent density ($\rho_{app}$) of the toner particles was determined according to the following procedure: 50 g of the mixture of the toner particles and 0.5% by weight of fumed hydrophobic silica having a specific surface area of 260 m2/g was weighed and introduced in a graduated glass cylinder with diameter of 35 mm. The cylinder was placed on top of a "tapping" device, STAV 2003, STAMPFVOLUMETER (trade name) available from JEL, J. Engelmann A.G., Ludwigshafen, Germany. This apparatus taps at a rate of 250 cycles pro minute. The mixture of toner particles and hydrophobic silica was tapped for 2000 cycles. Afterwards the volume was read in $cm^3$ ($\times cm^3$ for 50 g of mixture) and $\rho_{app}$ calculated as $$\rho_{app} = \frac{50\ \text{g}}{x\ \text{cm}^3}$$

The toner particles according to this invention can be applied to any transfer paper known in the art of textile printing. Such transfer material is disclosed in e.g. EP-A-146 504, EP-A-479 882, EP-A-684 337, EP-A-683 057, EP-A-692 742, etc.

The invention includes also a method for indirect textile printing comprising the steps of:

forming a toner image with toner particles comprising a thermosublimable dye on an intermediate substrate, contacting said image with the textile under pressure at elevated temperature for transferring sublimable dye contained in said image to said textile, and separating said image from said textile, characterised in that said toner particles comprise a toner resin and a thermosublimable dye wherein the resin has measured at 190° C. a viscosity, η, between 30 and 100 mPa.s and a tgd such that $0.010 \leqq tgd/\eta \leqq 0.20$.

In this method the toner particles used are preferably dry toner particles.

The substrate can be any substrate known in the art of electrostatic printing, but preferably a paper substrate is used.

EXAMPLES

General procedure for preparing the toner particles 90 parts by weight of a toner resin were melt-blended for 30 minutes at 110° C. in a laboratory kneader with 10 parts by weight of RESIREN RED TB (Colour Index Disperse Red 60, trade name of Bayer AG, Germany). After cooling the solidified mass was pulverised and milled using an ALPINE Fliessbettgegenstrahlmühle type 100AFG (trade name) and further classified using an ALPINE multiplex zig-zag classifier type 100MZR (trade name). The average particle size of the separated toner was measured by Coulter Counter model Multisizer (trade name) and was found to be 12 μm by volume.

The toner resins used are tabulated in Table 1.

TABLE 1

| # | Trade name and moieties forming the resin | Viscosity η at 190° C. | TGδ at 190° C. | TGδ/η |
|---|---|---|---|---|
| T1 | ATLAC T500 Polyester of bisphenol A and fumaric acid | 2.8 | 0.000 | 0 |
| T2 | DIANAL FB1431 Styrene/acrylic resin | 78.9 | 1.228 | 0.016 |
| T3 | AG 28 Hybrid polyester-styrene-acrylate | 32.4 | 1.110 | 0.034 |
| T4 | DIACRON FC043 polyester | 46.6 | 1.433 | 0.031 |
| T5 | DIACRON FC433 saturated crosslinked polyester | 41.3 | 1.810 | 0.044 |
| T6 | ALMACRYL XPE1676 polyester modified with urethane | 5.5 | 1.460 | 0.266 |
| T7 | AG4 crosslinked polyester | 4.0 | 2.580 | 0.640 |
| T8 | EPIKOTE 1009 an epoxy resin | 42.3 | 7.840 | 0.185 |

ATLAC T500: registered trade name of Atlas Chemical Industries Inc. Wilmington, Del. U.S.A.

DIANAL FB1431, DIACRON FC043 and DIACRON FC433: trade names of Mitsubishi Rayon, Toyohashi-shi, Japan.

EPIKOTE 1009: trade name of Shell Chemicals, Rotterdam, NL.

ALMACRYL XPE1676: trade name of Image Polymers Europe, Stirlinghouse, Scotland.

AG28 and AG 4: experimental products provided by KAO corp. Wakayama, Japan.

Developer composition

With each of the toners prepared from the resins T1 to T8, a multi-component developer was prepared by mixing each toner with 0.5% by weight fumed hydrophobic silica (AEROSIL R972, trade name of Degussa, Germany) and coated ferrite carrier with a volume average particle size of 50 mm, at a concentration of 5% toner weight with respect to the carrier and activated for 30 minutes in order to attain a stable charge level.

PRINTING EXAMPLES

The printing proceeded in X35 copier, trade name of Agfa-Gevaert NV Mortsel Belgium, so as to from even density patches on a transfer paper (Agfa paper 1001, trade name of Agfa-Gevaert NV Mortsel Belgium.

The paper prints contained 3 superposed toner layers, as is the case in multicolour prints.

The prints were contacted with a woven polyester and the prints and the polyester were kept under pressure of 4 bars for 20 seconds, then the print was immediately separated from the textile.

The contact area was 10.5 by 2.4 cm.

After separation of the print the density remaining on the transfer paper $D_p$ was measured as well as the density on the textile $D_t$. Both densities measured in reflection with a Gretag D19C densitometer.

The ratio $Dt/D_p$ is taken as a measure for the quality of dye transfer and indicated by Ratio.

On the patch of textile, the rigidity after transfer, which is a measure for the transfer of resin, is measured using the cantilever method according to ASTM D-1388. The percentage increase in bending length, BL, between the unprinted textile and the printed one is determined De overall quality of the toner particles is determined by dividing ratio by BL, so that the higher figure the better the result, since when the ratio is high and BL low, the toner particles give high colour transfer for low resin transfer.

A BL below 50% is acceptable since then the feel (commonly called the hand) of the fabric is acceptable in comparison with the hand of the unprinted textile and a value of Ratio/BL above 0.02 gives an acceptable colour transfer. T2 to T5 fulfil these requirements and are acceptable, T6 gives a borderline quality. The results are seen in table 2.

TABLE 2

| # | BL % | Ratio: $D_t/D_p$ | Ratio/BL |
|---|---|---|---|
| T1 | 110 | 0.66 | 0.006 |
| T2 | 7.7 | 1.19 | 0.154 |
| T3 | 18 | 1.65 | 0.092 |
| T4 | 43 | 1.10 | 0.026 |
| T5 | 23 | 1.00 | 0.043 |
| T6 | 95 | 1.30 | 0.013 |
| T7 | 85 | 1.27 | 0.015 |
| T8 | 54 | 1.05 | 0.0194 |

We claim:

1. Toner particles comprising a toner resin and a thermosublimable dye wherein the resin has measured at 190° C. a viscosity, η, between 30 and 100 mPa.s and a tgδ such that $0.010 \leqq tg\delta/\eta \leqq 0.20$.

2. Toner particles according to claim 1 wherein tgδ is such that $0.010 \leqq tg\delta/\eta \leqq 0.06$.

3. Toner particles according to claim 1, wherein tgδ is such that $0.010 \leqq tg\delta/\eta \leqq 0.03$.

4. Toner particles according to claim 1, wherein (i) said toner particles have as topological criterion that the ratio of the length of the long axis of the projected microscopic image of said particles to the length of the short axis, is between 1.00 and 1.40 and (ii) said toner particles after addition of 0.5% by weight of fumed hydrophobic silica having a specific surface area of 260 m2/g show a ratio of apparent density ($\rho_{app}$) over real density ($\rho_{real}$)

$$\frac{\rho_{app}}{\rho_{real}} \geq 0.52.$$

5. Toner particles according to claim 2, wherein (i) said toner particles have as topological criterion that the ratio of the length of the long axis of the projected microscopic image of said particles to the length of the short axis, is between 1.00 and 1.40 and (ii) said toner particles after addition of 0.5% by weight of fumed hydrophobic silica having a specific surface area of 260 m2/g show a ratio of apparent density ($\rho_{app}$) over real density ($\rho_{real}$)

$$\frac{\rho_{app}}{\rho_{real}} \geq 0.52.$$

6. Toner particles according to claim 3, wherein (i) said toner particles have as topological criterion that the ratio of the length of the long axis of the projected microscopic image of said particles to the length of the short axis, is between 1.00 and 1.40 and (ii) said toner particles after addition of 0.5% by weight of fumed hydrophobic silica having a specific surface area of 260 m2/g show a ratio of apparent density ($\rho_{app}$) over real density ($\rho_{real}$)

$$\frac{\rho_{app}}{\rho_{real}} \geq 0.52.$$

7. A method for indirect textile printing comprising the steps of:

forming a toner image with toner particles comprising a toner resin with a viscosity, η, between 30 and 100 mPa.s and a tgd such that $0.010 \leqq tg\delta/\eta \leqq 0.20$, both η and tgδ measured at 190° C., and a thermosublimable dye on an intermediate substrate, contacting said image with the textile under pressure at elevated temperature for transferring said thermosublimable dye contained in said image to said textile, and separating said image from said textile.

8. A method according to claim 7, wherein said toner particles are dry toner particles.

9. A method according to claim 7, wherein said toner image on said intermediate substrate is formed by Direct Electrostatic Printing.

10. A method according to claim 7, wherein said toner image on said intermediate substrate is formed by electrophotographic means.

* * * * *